US007201129B2

(12) United States Patent
Ohba et al.

(10) Patent No.: US 7,201,129 B2
(45) Date of Patent: Apr. 10, 2007

(54) INTAKE PIPE

(75) Inventors: Tohru Ohba, Toyota (JP); Atsushi Hirota, Kuwana (JP)

(73) Assignees: Toyota Jidosha Kabushiki Kaisha, Toyota-shi (JP); Denso Corporation, Kariya-shi (JP)

( * ) Notice: Subject to any disclaimer, the term of this patent is extended or adjusted under 35 U.S.C. 154(b) by 0 days.

(21) Appl. No.: 11/229,670

(22) Filed: Sep. 20, 2005

(65) Prior Publication Data

US 2006/0081214 A1 Apr. 20, 2006

(30) Foreign Application Priority Data

Oct. 14, 2004 (JP) ..... 2004-300435

(51) Int. Cl.
*F02M 35/10* (2006.01)
*F02M 35/108* (2006.01)

(52) U.S. Cl. ..... 123/184.21; 123/198 E

(58) Field of Classification Search .....
123/184.21–184.61, 198 E, 198 R; 180/903
See application file for complete search history.

(56) References Cited

U.S. PATENT DOCUMENTS 5,970,963 A * 10/1999 Nakase et al. ..... 123/590
6,085,712 A * 7/2000 Ma ..... 123/184.42
6,647,956 B1 * 11/2003 Sharpton ..... 123/339.1
2002/0059912 A1 * 5/2002 Bauer et al. ..... 123/198 E
2006/0069492 A1 * 3/2006 Muto et al. ..... 701/103

FOREIGN PATENT DOCUMENTS

JP 2004-169688 6/2004

* cited by examiner

*Primary Examiner*—Marguerite McMahon
(74) *Attorney, Agent, or Firm*—Kenyon & Kenyon LLP

(57) ABSTRACT

An intake pipe includes a plurality of passages that join in a section upstream of the throttle body. The intake pipe includes an interference prevention member that prevents air passing through a specific one of the passages from flowing into the other passages. The interference prevention member is a thin plate and is formed in a confluence portion of an adjacent pair of the passages.

12 Claims, 8 Drawing Sheets

INTAKE PIPE

BACKGROUND OF THE INVENTION

The present invention relates to an intake pipe.

For example, in a gasoline engine, air is drawn through an inlet of an intake pipe is mixed with fuel injected by a fuel injection valve, and the air-fuel mixture is burned in a combustion chamber. In recent years, engines of large displacement are equipped with an intake pipe having a plurality of inlets to supply a greater flow rate of air to combustion chambers. Japanese Laid-Open Patent Publication No. 2004-169688 discloses such an intake pipe that has two passages to draw air to an engine. Each passage has an inlet and an air cleaner.

In this intake pipe, when the flow rate of air (intake pressure) drawn through a first inlet 10*a* is different from that of a second inlet 10*b* as shown in FIG. 16, some of the air that has passed through a first passage 50*a* can flow to a second passage 50*b* without flowing to a throttle body 40. FIG. 16 illustrates a case where the intensity of air flow produced as a vehicle moves varies from left to right. That is, FIG. 16 shows the flow of air taken through the first and second inlets 10*a*, 10*b*. Arrow A shows the flow of air that is taken through the first inlet 10*a* and flows to the throttle body 40. Arrow B shows flow of air that is taken through the first inlet 10*a* and flows into the second passage 50*b* via a confluence portion 55 of the first and second passages 50*a*, 50*b*.

In such a case, some of the air that should be flowing to the throttle body 40 flows into the second passage 50*b*. This causes supply of air to the combustion chambers to be insufficient. As a result, the intake efficiency of an engine 30 can deteriorate. The air that flows into the second passage 50*b* disturbs output signals from first and second air flowmeters 70*a*, 70*b*, causing errors in measured values of the flow rate of air. Particularly, to comply with the current emission control, the air flow rate is desired to be accurately measured.

SUMMARY OF THE INVENTION

Accordingly, it is an objective of the present invention to provide an intake pipe having a plurality of passages, which intake pipe prevents air from flowing between the passages.

To achieve the foregoing and other objectives and in accordance with the purpose of the present invention, an intake pipe for introducing air to a throttle body of an engine is provided. The intake pipe includes a plurality of passages and an interference prevention member. The passages join in a section upstream of the throttle body. The interference prevention member prevents air passing through a specific one of the passages from flowing into the other passages.

The present invention provides another intake pipe for introducing air to a throttle body of an engine. The intake pipe includes a plurality of passages and an interference prevention member. The passages have different cross-sectional areas, and join in a section upstream of the throttle body. The interference prevention member prevents air passing through a specific one of the passages from flowing into the other passages. The interference prevention member is formed in one of the passages that has the largest cross-sectional area.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

An intake pipe according to a preferred embodiment of the present invention will now be described with reference to FIGS. 1 to 3.

Figure 1:
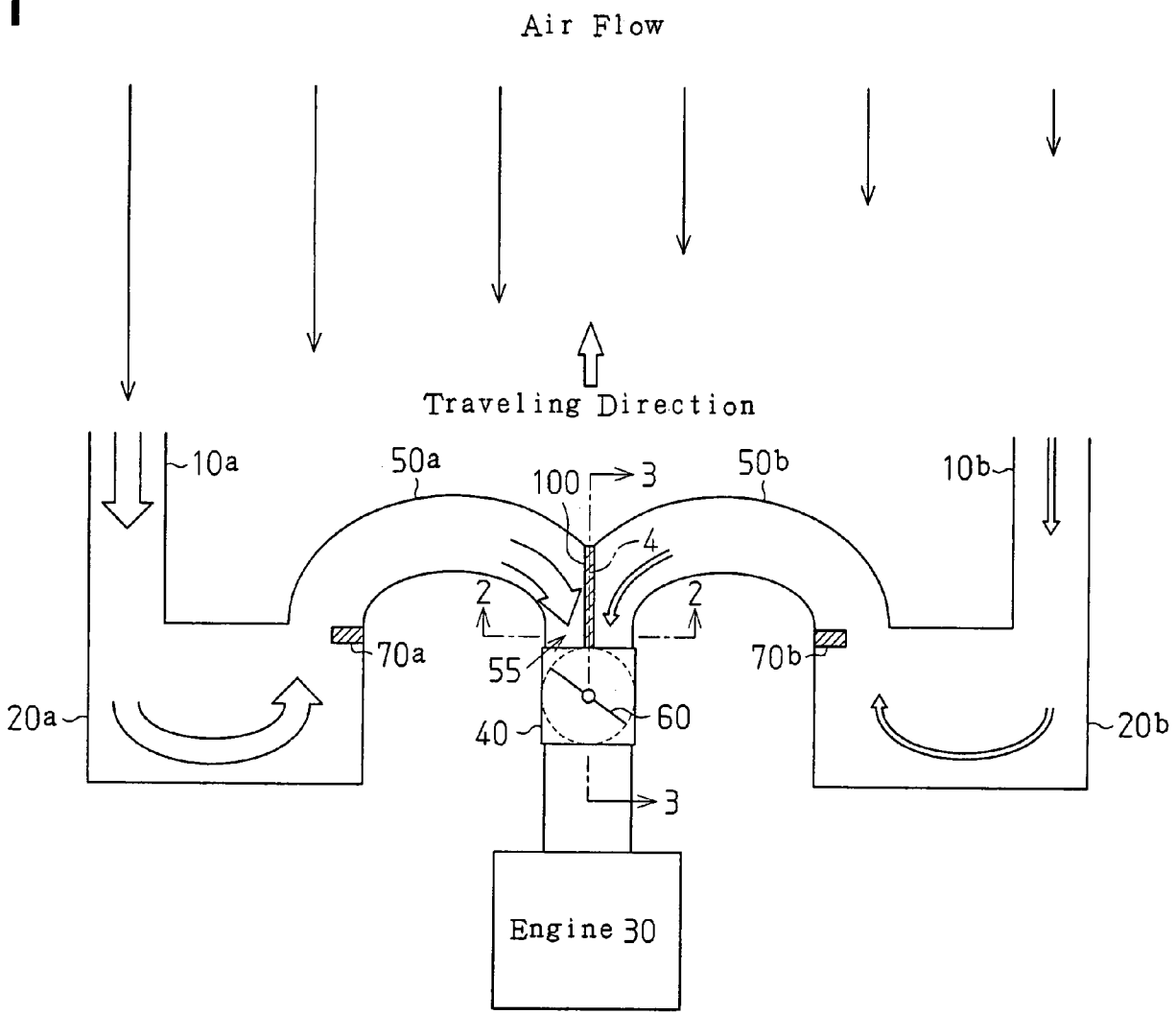
FIG. 1 is a cross-sectional view illustrating the entire structure of an intake pipe according to a preferred embodiment.

As shown in FIG. 1, the intake pipe includes first and second inlets 10*a*, 10*b* and first and second air cleaners 20*a*, 20*b*, each corresponding to one of the first and second inlets 10*a*, 10*b*. The first and second inlets 10*a*, 10*b* both are open toward the traveling direction of the vehicle (forward). The first and second air cleaners 20*a*, 20*b* are located downstream of the corresponding one of the first and second inlets 10*a*, 10*b*. The first and second inlets 10*a*, 10*b* and the first and second air cleaners 20*a*, 20*b* are both located on the sides of an engine 30.

The intake pipe also includes first and second passages 50*a*, 50*b*. The first and second passages 50*a*, 50*b* are located downstream of the first and second air cleaners 20*a*, 20*b*, respectively. The first and second passages 50*a*, 50*b* pass through the first and second air cleaners 20*a*, 20*b* and a throttle body 40 located in the vicinity of the engine 30. One end of each of the first and second passages 50*a*, 50*b* communicates with an outlet of the corresponding one of the first and second air cleaners 20*a*, 20*b*. The other ends of the first and second passages 50*a*, 50*b* are joined in a section upstream of the throttle body 40 and communicate with throttle body 40 in a joined state. Substantially middle sections of the first and second passages 50*a*, 50*b*, which are between the first and second air cleaners 20*a*, 20*b* and the throttle body 40, extend substantially perpendicular to the fore and aft direction of the vehicle. The first and second passages 50*a*, 50*b* are formed of resin.

Air taken into the intake pipe through the first and second inlets 10*a*, 10*b* passes through and is filtered by the first and second air cleaners 20*a*, 20*b*. The air filtered by the first and second air cleaners 20*a*, 20*b* passes through the first and second passages 50*a*, 50*b*. Then, the air merges at a confluence portion 55 of the first and second passages 50*a*, 50*b* and flows into the throttle body 40. The throttle body 40 adjusts the flow rate of air supplied to the engine 30 according to the opening degree of a throttle valve 60.

First and second air flowmeters 70*a*, 70*b* are located in the vicinity of the outlets of the first and second air cleaners 20*a*, 20*b* to measure the flow rate of air passing through the first and second passages 50*a*, 50*b*. In this embodiment, the intake pipe includes a thin plate 100 that functions as an interference prevention member. The thin plate 100 is arranged along a boundary plane 4 between the first and second passages 50*a*, 50*b*. The boundary plane 4 refers to a plane that forms the boundary between the first and second passages 50*a*, 50*b*.

Figure 2:
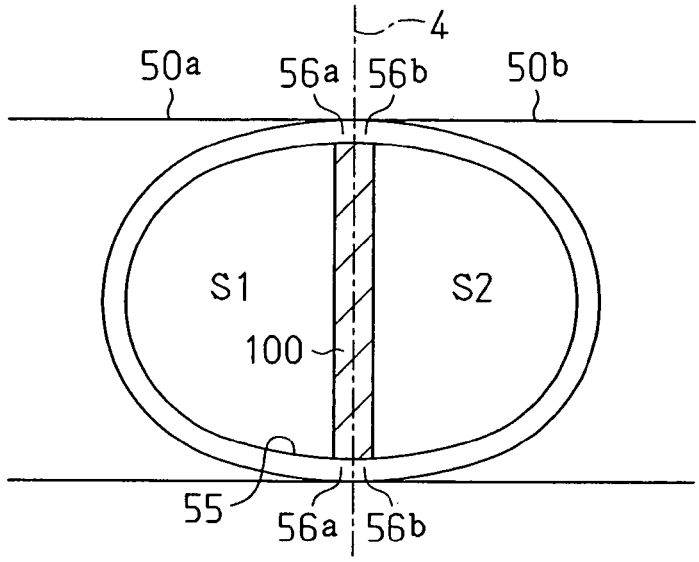
FIG. 2 is a cross-sectional view taken along line 2—2 of FIG. 1.

As shown in FIG. 2, the upper end and the lower end of the thin plate 100 each extend to a circumferential wall 56*a* of the first passage 50*a* and a circumferential wall 56*b* of the second passage 50*b* at the confluence portion 55 of the first and second passages 50*a*, 50*b*. The thin plate 100 overlaps the entire cross-section along the boundary plane 4 between the first and second passages 50*a*, 50*b*. The thin plate 100 parts the first passage 50*a* and the second passage 50*b* at the confluence portion 55 such that cross-sectional areas S1, S2 of cross-sections along a plane perpendicular to the boundary plane 4 (see FIG. 2) are equal to each other.

Figure 3:
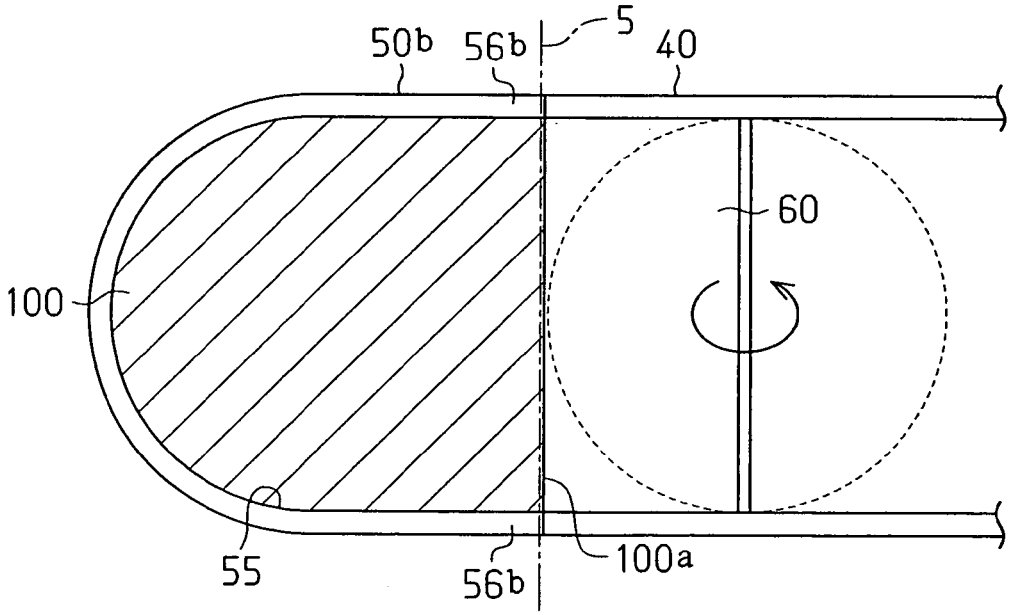
FIG. 3 is a cross-sectional view taken along line 3—3 of FIG. 1.

As shown in FIG. 3, an edge 100*a* of the thin plate 100 that faces the throttle valve 60 is formed linearly. A narrow clearance exits between the throttle valve 60 and the thin plate 100 when the throttle valve 60 is fully opened so that the throttle valve 60 and the thin plate 100 do not contact each other. The thin plate 100 is preferably formed of resin and integrally molded with the first and second passages 50*a*, 50*b*.

Figure 4:
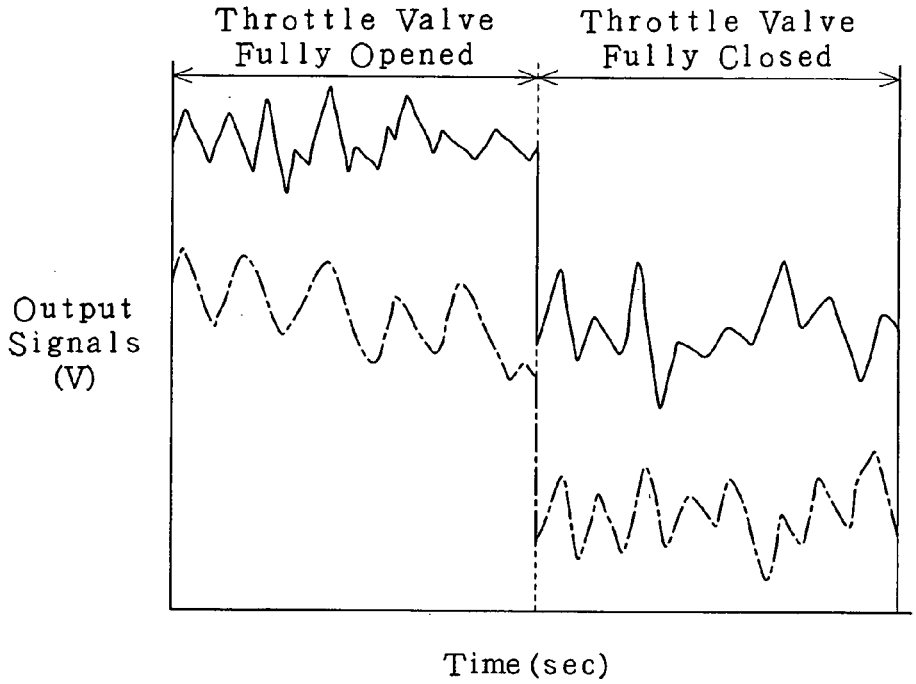
Fig.4 (Prior Art)
FIG. 4 is a graph showing changes of output signals of air flowmeters in a case where there is air flow in a prior art intake pipe.
Figure 16:
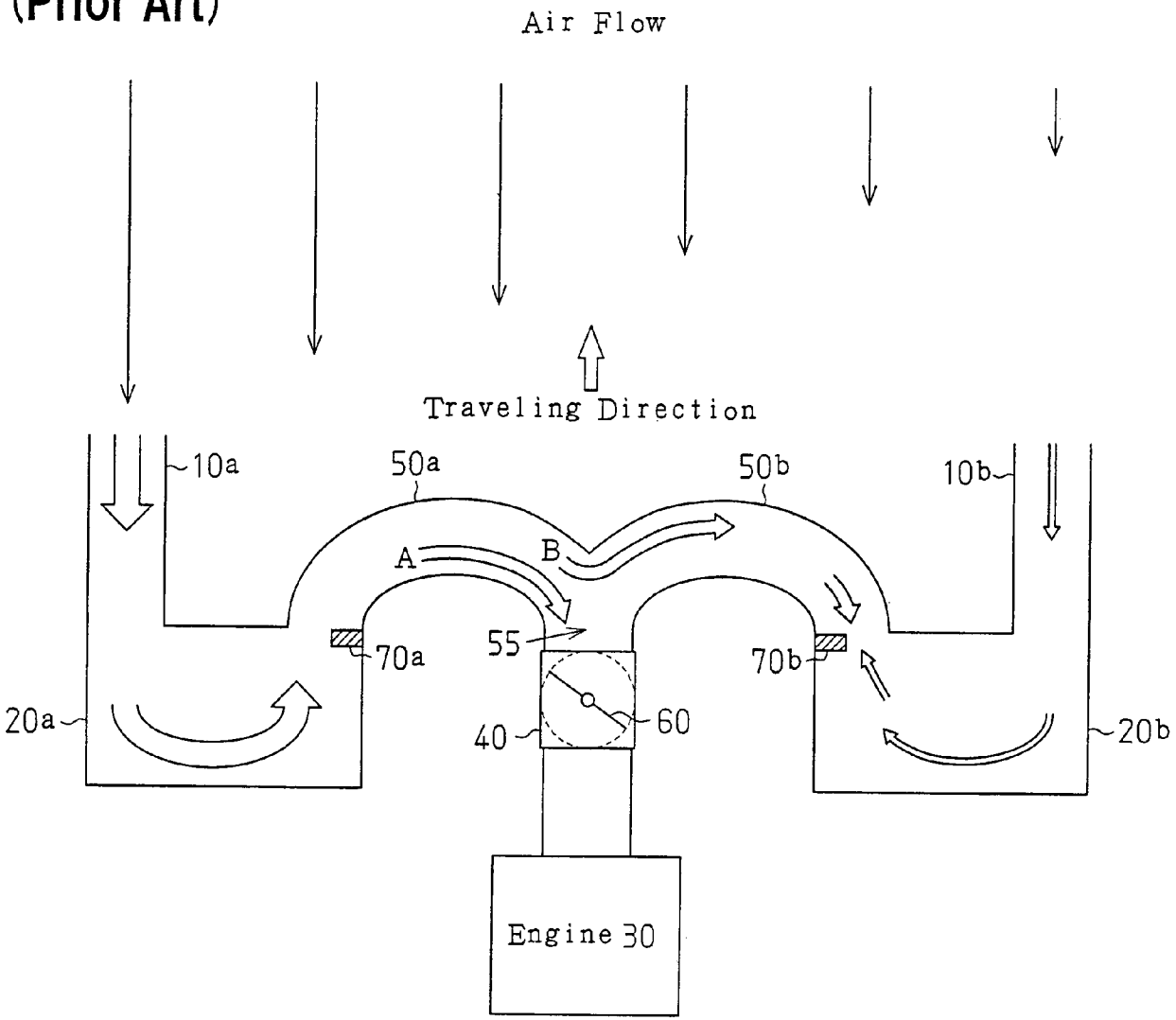
Fig.16 (Prior Art)
FIG. 16 is a cross-sectional view illustrating the entire structure of a prior art intake pipe.

FIG. 4 is a graph showing changes of output signals from the first and second air flowmeters 70*a*, 70*b* when located in the prior art intake pipe shown in FIG. 16. Specifically, FIG. 4 shows a case where the intensity of air flow varies from left to right of the vehicle. In FIG. 4, the solid line represents changes of the output signal from the first air flowmeter 70*a*, and the dashed line represents changes of the output signal from the second air flowmeter 70*b*. Likewise, in each of FIGS. 5 to 7, the solid line represents changes of the output signal from the first air flowmeter 70*a*, and the dashed line represents changes of the output signal from the second air flowmeter 70*b*.

In these cases, since the flow rate of air taken into the first inlet 10*a* is significantly different from the flow rate of air taken into the second inlet 10*b*, some of the air passing through the first passage 50*a* flows into the second passage 50*b*, which disturbs the output signals from the first and second air flowmeters 70*a*, 70*b*. Particularly, when the throttle valve 60 is fully or substantially fully closed, the flow rate of air passing through the throttle valve 60 is reduced. Accordingly, the flow rate of air that flows from the first passage 50*a* to the second passage 50*b* increases. This further increases the disturbance of the output signals from the first and second air flowmeters 70*a*, 70*b*.

Figure 5:
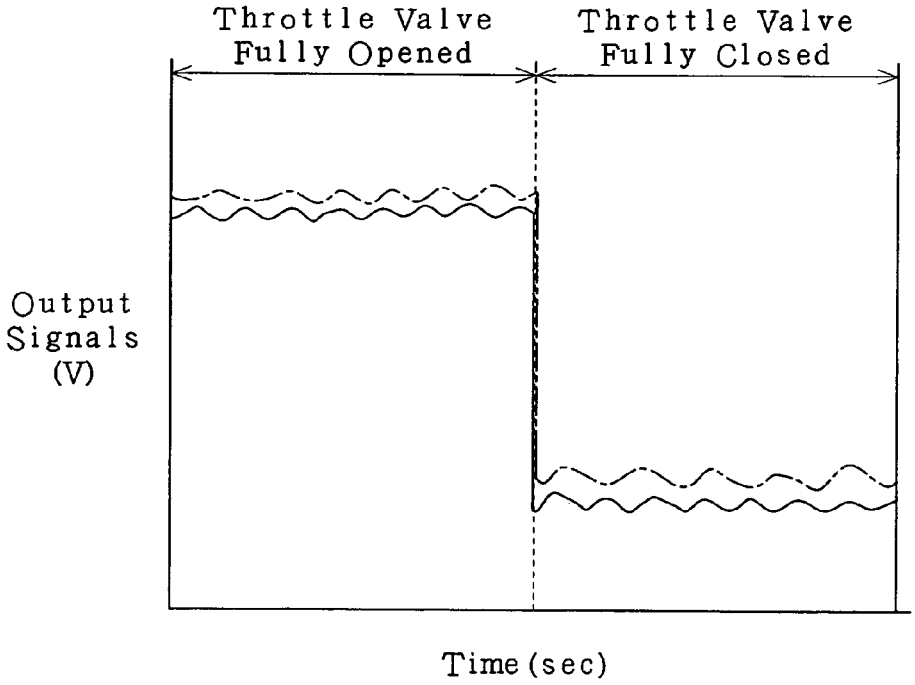
Fig.5 (Prior Art)
FIG. 5 is a graph showing changes of output signals of air flowmeters in a case where there is no air flow in a prior art intake pipe.

FIG. 5 is also a graph showing changes of output signals from the first and second air flowmeters 70*a*, 70*b* when located in the prior art intake pipe. Specifically, FIG. 5 shows a case where there is no air flow. In this case, since the flow rate of air taken into the first inlet 10*a* is not significantly different from the flow rate of air taken into the second inlet 10*b*, the air passing through the first passage 50*a* hardly flows into the second passage 50*b*. The output signals from the first and second air flowmeters 70*a*, 70*b* are hardly disturbed. The degree of fluctuations of the output signals from the first and second air flowmeters 70*a*, 70*b* does not vary significantly between a case where the throttle valve 60 is fully opened and a case where the throttle valve 60 is fully or substantially fully closed.

Figure 6:
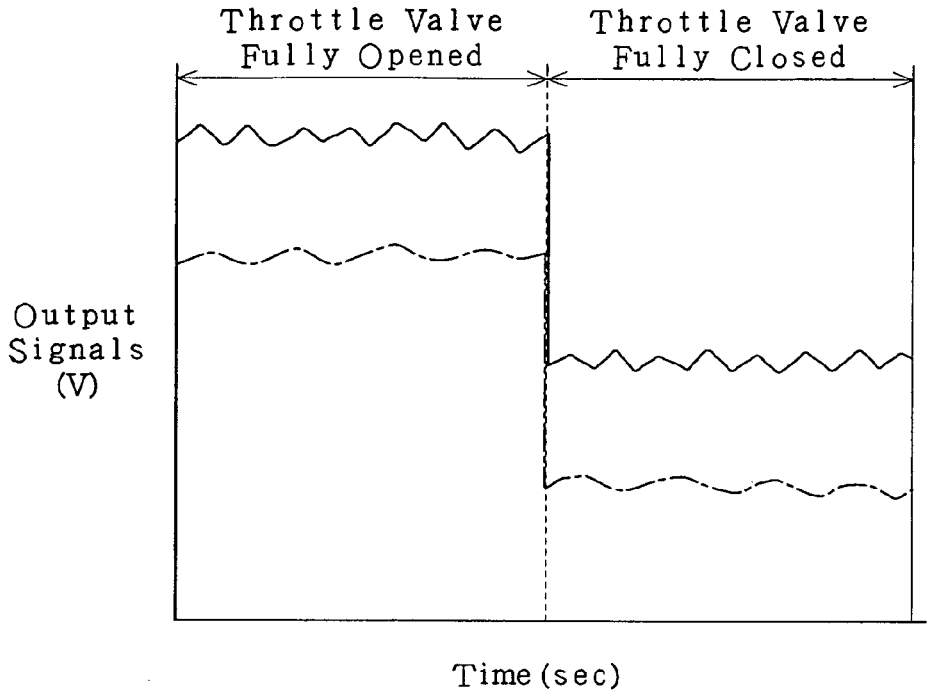
FIG. 6 is a graph showing changes of output signals of air flowmeters in a case where there is air flow in the intake pipe according to the preferred embodiment.

FIG. 6 is a graph showing changes of output signals from the first and second air flowmeters 70*a*, 70*b* when located in the intake pipe according to the present invention, which has the thin plate 100. Specifically, FIG. 6 shows a case where the intensity of air flow varies from left to right of the vehicle. In this case, although the flow rate of air taken into the first inlet 10*a* is significantly different from the flow rate of air taken into the second inlet 10*b*, the disturbance of the output signals from the first and second air flowmeters 70*a*, 70*b* is reduced to a low level. Even if the throttle valve 60 is fully or substantially fully closed, disturbance of the output signals from the first and second air flowmeters 70*a*, 70*b* is reduced to a low level. Therefore, in the intake pipe of the present invention, the thin plate 100 prevents air passing through one of the first and second passages 50*a*, 50*b* from flowing into the other one of the passages 50*a*, 50*b* without being influenced by the opening state of the throttle valve 60.

Figure 7:
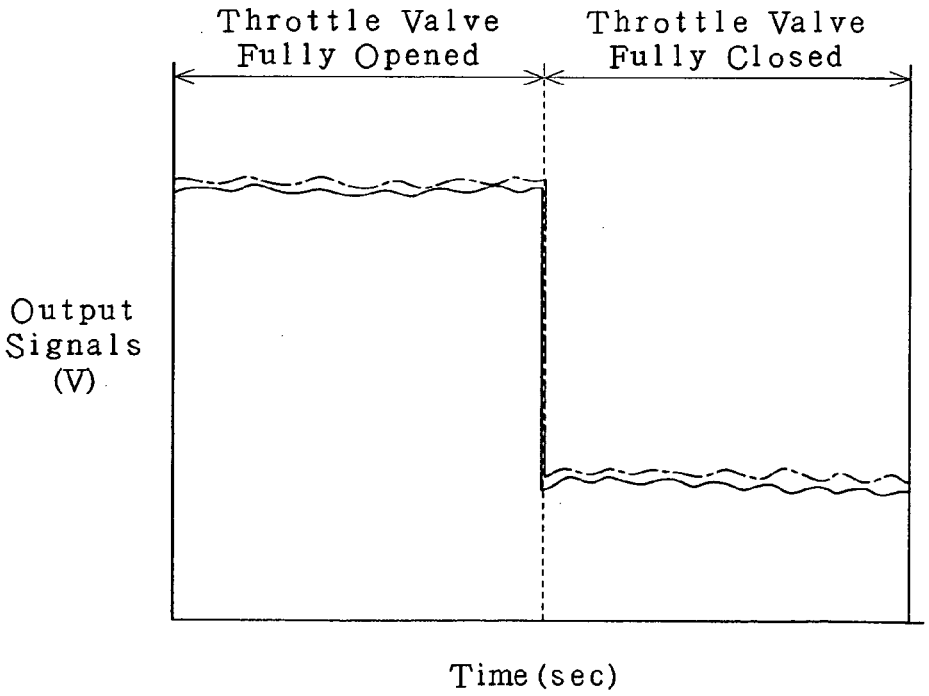
FIG. 7 is a graph showing changes of output signals of air flowmeters in a case where there is no air flow in the intake pipe according to the preferred embodiment.

FIG. 7 is a graph showing changes of output signals from the first and second air flowmeters 70*a*, 70*b* when located in the intake pipe according to the present invention. Specifically, FIG. 7 shows a case where there is no air flow.

In this case, since the flow rate of air taken into the first inlet 10*a* is not significantly different from the flow rate of air taken into the second inlet 10*b*, the air passing through the first passage 50*a* hardly flows into the second passage 50*b*. The output signals from the first and second air flowmeters 70*a*, 70*b* are hardly disturbed. The degree of fluctuations of the output signals from the first and second air flowmeters 70*a*, 70*b* does not vary significantly between a case where the throttle valve 60 is fully opened and a case where the throttle valve 60 is fully or substantially fully closed.

The above embodiment has the following advantages.

(1) The thin plate 100, which functions as an interference prevention member, is provided. Therefore, even if the flow rates of air taken into the first and second inlets 10*a*, 10*b* are different, air passing through one of the first and second passages 50*a*, 50*b* does not flow into the other one of the passages 50*a*, 50*b*. For example, when there is air flow as shown FIG. 1, the flow rate of air taken into the first inlet 10*a* is greater than the flow rate of air taken into the second inlet 10*b*. In such a case, the thin plate 100 prevents air taken into the first inlet 10*a* from flowing from the first passage 50*a* to the second passage 50*b*. This prevents the intake efficiency of the engine 30 from deteriorating.

(2) The thin plate 100 is arranged along a boundary 4 between the first and second passages 50*a*, 50*b*. Simply arranging the single thin plate 100 along the boundary plane 4 prevents air passing through one of the first and second passages 50*a*, 50*b* from flowing into the other one of the passages 50*a*, 50*b*. That is, the thin plate 100 has a simple structure that functions as an interference prevention member.

(3) The thin plate 100 prevents air passing through the first and second passages 50*a*, 50*b* from interfering each other. This reduces disturbance of the output signals from the first and second air flowmeters 70*a*, 70*b* to a low level, and thus allows the flow rates of air to be accurately measured.

(4) The thin plate 100 overlaps the entire cross-section along the boundary plane 4 between the first and second passages 50*a*, 50*b*. This structure prevents air passing through one of the first and second passages 50*a*, 50*b* from flowing into the other one of the passages 50*a*, 50*b* in the entire cross-section along the boundary plane 4 of the first and second passages 50*a*, 50*b*.

(5) A narrow clearance exits between the throttle valve 60 and the thin plate 100 when the throttle valve 60 is fully opened so that the throttle valve 60 and the thin plate 100 do not contact each other. This structure prevents air passing through one of the first and second passages 50*a*, 50*b* from flowing into the other one of the passages 50*a*, 50*b* without influencing the opening operation of the throttle valve 60.

The above described embodiments may be modified as follows.

Figure 8:
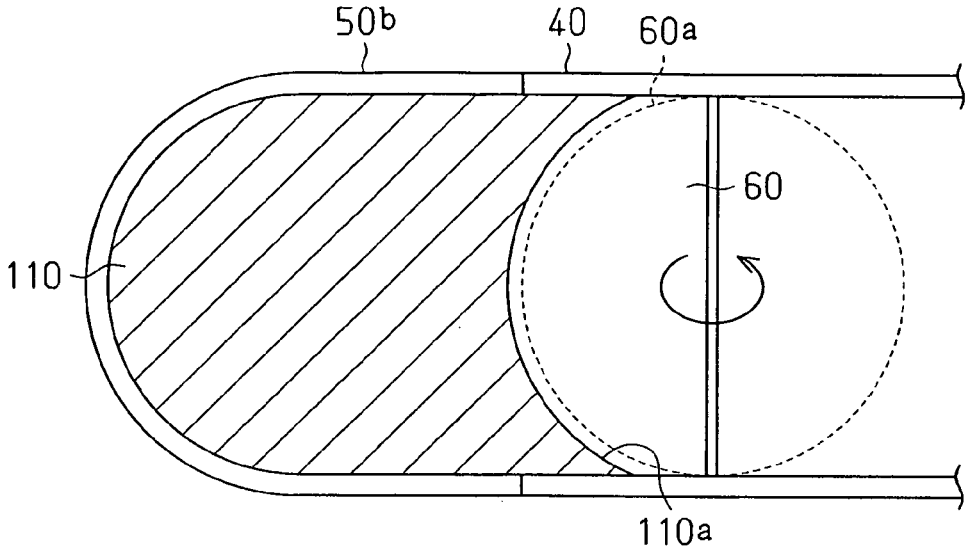
FIG. 8 is a cross-sectional view illustrating an intake pipe of a modified embodiment.
Figure 9:
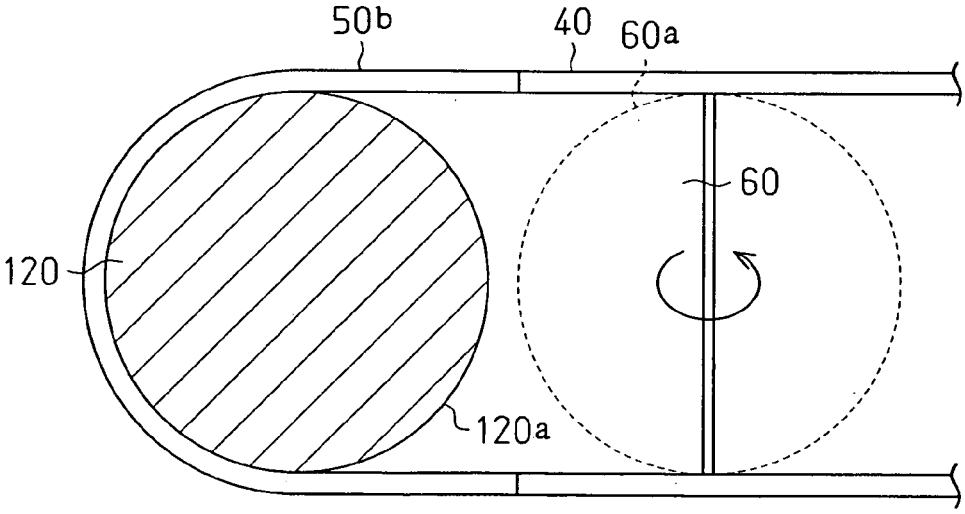
FIG. 9 is a cross-sectional view illustrating an intake pipe of a modified embodiment.

The shape of the thin plate 100 is not limited to the shape presented in the above embodiment, but may be changed arbitrarily. For example, a thin plate 110 having an edge 110*a* shaped as shown in FIG. 8 may be used. The edge 110*a* is shaped to follow the shape of an edge 60*a* of the throttle valve 60, or, shaped to form an arcuate concave. In this case, when the throttle valve 60 is fully opened, the clearance between the throttle valve 60 and the thin plate 110 can be further reduced. Also, a thin plate 120 having an edge 120*a* shaped as shown in FIG. 9 may be used. The edge 120*a* is shaped to be closer to the throttle valve 60 at a middle section than at the upper and lower end portions. That is, the edge 120*a* may be shaped to form an arcuate convex. The distribution of flow rate of air passing through the first and second passages 50*a*, 50*b* generally becomes greater toward the center of the first and second passages 50*a*, 50*b*. Therefore, the thin plate 120 shown in FIG. 9 is capable of preventing air passing through one of the first and second passages 50*a*, 50*b* from flowing into the other one of the passages 50*a*, 50*b*.

Figure 10:
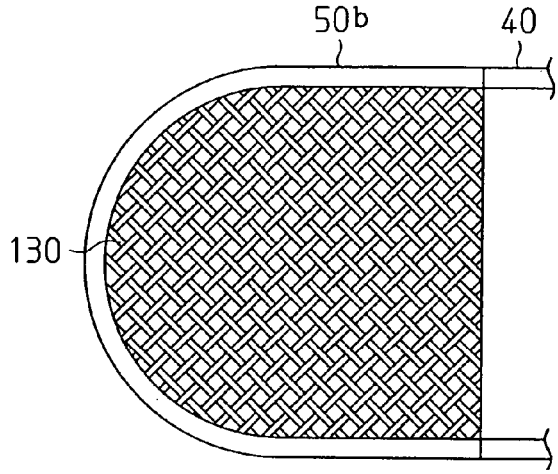
FIG. 10 is a cross-sectional view illustrating an intake pipe of a modified embodiment.
Figure 11:
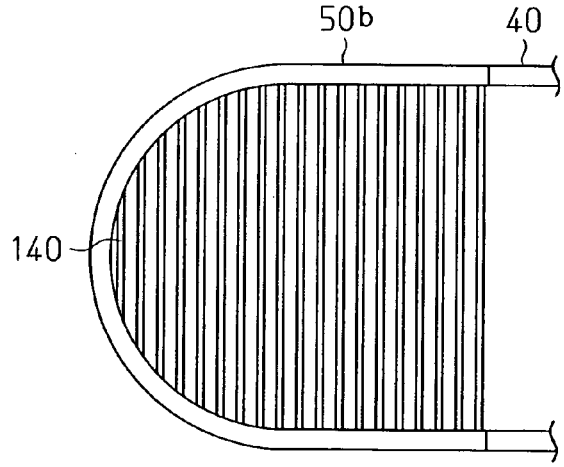
FIG. 11 is a cross-sectional view illustrating an intake pipe of a modified embodiment.
Figure 12:
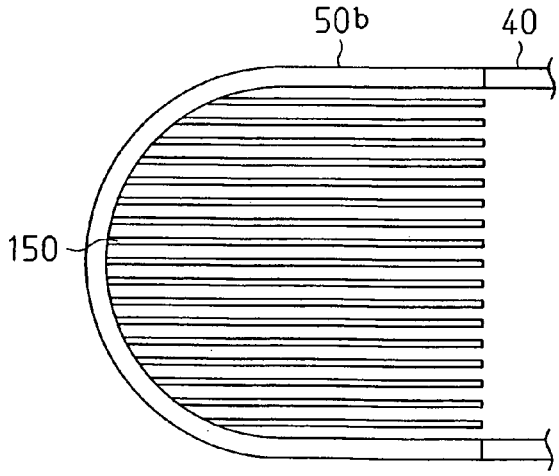
FIG. 12 is a cross-sectional view illustrating an intake pipe of a modified embodiment.

The thin plate 100, which functions as an interference prevention member, may be replaced by any of a mesh member 130 shown in FIG. 10 and grid members 140, 150 shown in FIGS. 11 and 12. In these cases, to prevent air passing through one of the first and second passages 50*a*, 50*b* from flowing into the other one of the passages 50*a*, 50*b*, the interstices of the mesh member 130 and the space between the bars of the grid members 140, 150 are preferably small.

Figure 13:
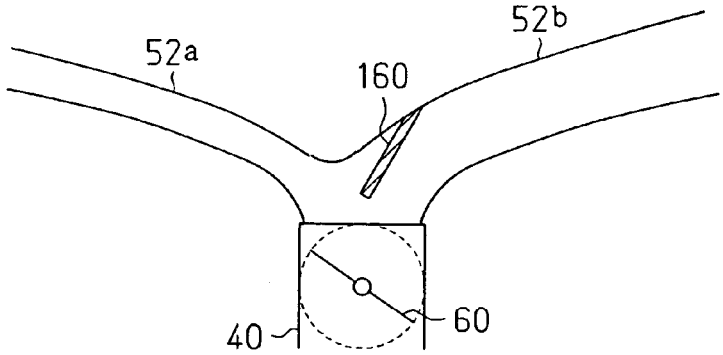
FIG. 13 is a cross-sectional view illustrating an intake pipe of a modified embodiment.

In a case of an intake pipe that has first and second passages 52*a*, 52*b* of different cross-sectional areas as shown in FIG. 13, a thin plate 160 may be provided only in the second passage 52*b* of the greater cross-sectional area. Although the thin plate 160 is provided only in one of the first and second passages 52*a*, 52*b*, it is possible to prevent air passing through one of the first and second passages 52*a*, 52*b* from flowing into the other one of the passages 52*a*, 52*b*.

Figure 14:
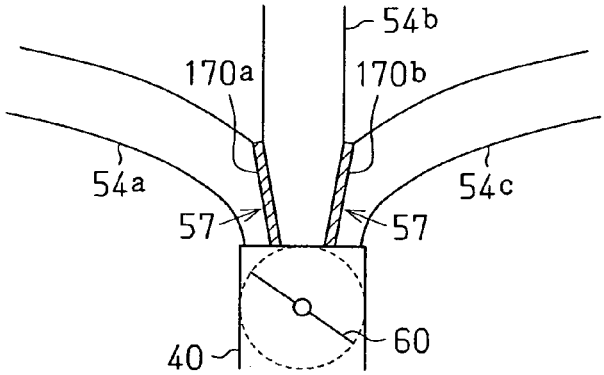
FIG. 14 is a cross-sectional view illustrating an intake pipe of a modified embodiment.

In a case of an intake pipe that has three passages 54*a*, 54*b*, 54*c* as shown in FIG. 14, thin plates 170*a*, 170*b* may be provided in adjacent two confluence portions 57, respectively.

Figure 15:
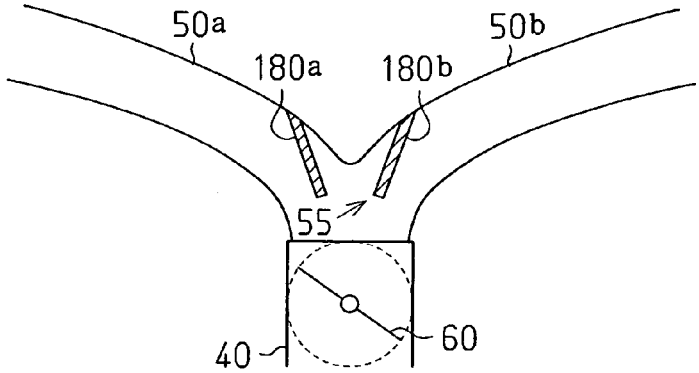
FIG. 15 is a cross-sectional view illustrating an intake pipe of a modified embodiment.

The position and number the thin plate 100 are not limited to the position and number presented in the above embodiments, but may be changed arbitrarily. For example, as shown in FIG. 15, first and second thin plates 180*a*, 180*b* may be located in sections upstream of the confluence portion 55 in the first and second passages 50*a*, 50*b*, respectively.

The invention claimed is:

1. An intake pipe for introducing air to a throttle body of an engine, the intake pipe comprising:

a plurality of passages that join in a section upstream of the throttle body; and an interference prevention member that prevents air passing through a specific one of the passages from flowing into the other passages, wherein the interference prevention member is formed in a confluence portion of an adjacent pair of the passages, wherein the interference prevention member is formed along a boundary plane in the confluence portion of the adjacent passages, wherein the interference prevention member is a thin plate that is provided along the boundary plane.

2. The intake pipe according to claim 1, wherein, when a throttle valve is fully opened, a clearance is defined between the throttle valve and the interference prevention member.

3. The intake pipe according to claim 2, wherein an upper end portion and a lower end portion of the thin plate each extend to a circumferential wall of the adjacent passages.

4. The intake pipe according to claim 3, wherein the thin plate is formed to extend over an entire cross-sectional area along the boundary plane of the adjacent passages.

5. The intake pipe according to claim 4, wherein the thin plate parts the adjacent passages such that cross-sectional areas of cross-sections of the adjacent passages along a plane perpendicular to the boundary plane are equal to each other.

6. The intake pipe according to claim 3, wherein an edge of the thin plate that faces the throttle valve is formed to conform an edge of the throttle valve.

7. The intake pipe according to claim 3, wherein an edge of the thin plate that faces the throttle valve is shaped to be closer to the throttle valve at a middle section than at the upper and lower end portions.

8. An intake pipe for introducing air to a throttle body of an engine, the intake pipe comprising:

a plurality of passages that join in a section upstream of the throttle body; and an interference prevention member that prevents air passing through a specific one of the passages from flowing into the other passages, wherein the interference prevention member is formed in a confluence portion of an adjacent pair of the passages, wherein the interference prevention member is formed along a boundary plane in the confluence portion of the adjacent passages, wherein the interference prevention member is a mesh member that is provided along the boundary plane.

9. An intake pipe for introducing air to a throttle body of an engine, the intake pipe comprising:

a plurality of passages that join in a section upstream of the throttle body; and an interference prevention member that prevents air passing through a specific one of the passages from flowing into the other passages, wherein the interference prevention member is formed in a confluence portion of an adjacent pair of the passages, wherein the interference prevention member is formed along a boundary plane in the confluence portion of the adjacent passages, wherein the interference prevention member is a grid member that is provided along the boundary plane.

10. An intake pipe for introducing air to a throttle body of an engine, the intake pipe comprising:

a plurality of passages having different cross-sectional areas, the passages joining in a section upstream of the throttle body; and an interference prevention member that prevents air passing through a specific one of the passages from flowing into the other passages, wherein the interference prevention member is formed in one of the passages that has the largest cross-sectional area, wherein the interference prevention member is a thin plate that is provided along the boundary plane.

11. An intake pipe for introducing air to a throttle body of an engine, the intake pipe comprising:

a plurality of passages having different cross-sectional areas, the passages joining in a section upstream of the throttle body; and an interference prevention member that prevents air passing through a specific one of the passages from flowing into the other passages, wherein the interference prevention member is formed in one of the passages that has the largest cross-sectional area, wherein the interference prevention member is a mesh member that is provided along the boundary plane.

12. An intake pipe for introducing air to a throttle body of an engine, the intake pipe comprising:

a plurality of passages having different cross-sectional areas, the passages joining in a section upstream of the throttle body; and an interference prevention member that prevents air passing through a specific one of the passages from flowing into the other passages, wherein the interference prevention member is formed in one of the passages that has the largest cross-sectional area, wherein the interference prevention member is a grid member that is provided along the boundary plane.

* * * * *